US009429343B2

(12) United States Patent
Honda

(10) Patent No.: US 9,429,343 B2
(45) Date of Patent: Aug. 30, 2016

(54) HEAT PUMP SYSTEM

(75) Inventor: Masahiro Honda, Sakai (BE)

(73) Assignees: Daikin Industries, Ltd., Osaka (JP); Daikin Europe N.V., Oostende (BE)

( * ) Notice: Subject to any disclaimer, the term of this patent is extended or adjusted under 35 U.S.C. 154(b) by 1057 days.

(21) Appl. No.: 13/574,766

(22) PCT Filed: Jan. 29, 2010

(86) PCT No.: PCT/JP2010/000530

§ 371 (c)(1),
(2), (4) Date: Jul. 23, 2012

(87) PCT Pub. No.: WO2011/092741

PCT Pub. Date: Aug. 4, 2011

(65) Prior Publication Data

US 2012/0297808 A1 Nov. 29, 2012

(51) Int. Cl.

*F25B 13/00* (2006.01)
*F24D 19/10* (2006.01)
*F25B 30/02* (2006.01)

(52) U.S. Cl.

CPC ..... *F25B 13/00* (2013.01); *F24D 19/1072* (2013.01); *F25B 30/02* (2013.01); *F25B 2313/0314* (2013.01); *F25B 2313/0315* (2013.01); *F25B 2339/047* (2013.01); (Continued)

(58) Field of Classification Search

CPC F25B 13/00; F25B 30/02; F25B 2313/0314; F25B 2313/0315; F25B 2339/047; F25B 2400/01; F25B 2400/13; F25B 2500/19; F25D 19/1072

USPC ..... 62/160, 181, 183

See application file for complete search history.

(56) References Cited

U.S. PATENT DOCUMENTS

2008/0041072 A1 2/2008 Seefeldt

FOREIGN PATENT DOCUMENTS

GB 1 553 268 9/1979
JP 7-269964 A 10/1995

(Continued)

OTHER PUBLICATIONS

International Preliminary Report of corresponding PCT Application No. PCT/JP2010/000530.

(Continued)

*Primary Examiner* — Marc Norman
(74) *Attorney, Agent, or Firm* — Global IP Counselors

(57) ABSTRACT

A refrigerant circuit includes a compressor, a heat source-side heat exchanger, and a usage-side heat exchanger capable of heating an aqueous medium. An aqueous medium circuit includes a circulation pump and the usage-side heat exchanger, and is connected to aqueous medium devices. An auxiliary heat source is provided at an outlet side of the usage-side heat exchanger in the aqueous medium circuit to further heat the aqueous medium. A heating capability computation unit computes a heating capability of the aqueous medium devices based on an operating state quantity of constituent devices or refrigerant flowing through the refrigerant circuit. A circulation flow rate computation unit computes a circulation flow rate of the aqueous medium based on an outlet/inlet temperature difference and the heating capability. A prediction unit predicts an outlet temperature of the aqueous medium in the auxiliary heat source based on the circulation flow rate and heat source capability information.

14 Claims, 6 Drawing Sheets

(52) U.S. Cl.
CPC ..... *F25B2400/01* (2013.01); *F25B 2400/13* (2013.01); *F25B 2500/19* (2013.01)

(56) References Cited

FOREIGN PATENT DOCUMENTS

| | | | |
|---|---|---|---|
| JP | 2000-65398 | A | 3/2000 |
| JP | 2001-221482 | A | 8/2001 |
| JP | 2003-65585 | A | 3/2003 |
| JP | 2003-314838 | A | 11/2003 |
| JP | 2005-241088 | A | 9/2005 |
| JP | 2009-204270 | A | 9/2009 |

OTHER PUBLICATIONS

International Search Report of corresponding PCT Application No. PCT/JP2010/000530.

European Search Report of corresponding EP Application No. 10 84 4514.9 dated Apr. 28, 2014.

HEAT PUMP SYSTEM

TECHNICAL FIELD

The present invention relates to a heat pump system, and particularly relates to a heat pump system in which an aqueous medium can be heated using a heat pump cycle.

BACKGROUND ART

In conventional practice, there has been heat pump-type warm-water heating apparatuses in which water can be heated using a heat pump cycle, such as the apparatus disclosed in Japanese Laid-open Patent Application No. 2003-314838. The heat pump-type warm-water heating apparatus comprises primarily an outdoor unit having a variable-capacity-type heat source-side compressor and a heat source-side heat exchanger, and a warm-water supply unit having a refrigerant-water heat exchanger and a circulation pump. The heat source-side compressor, the heat source-side heat exchanger, and the refrigerant-water heat exchanger constitute a heat source-side refrigerant circuit. With this heat pump-type warm-water heating apparatus, water is heated by the heat radiation of refrigerant in the refrigerant-water heat exchanger. The warm water thus obtained is increased in pressure by the circulation pump, then stored in a tank or supplied to, for example, a floor heating device or various other aqueous medium devices.

SUMMARY

Technical Problem

In the apparatus described above, an auxiliary heat source is sometimes provided to a portion where warm water flows once heat has been exchanged in the refrigerant-water heat exchanger, in order to compensate for a decrease in the aqueous medium heating capability in a case where the outside air temperature is low and/or a case where an outdoor heat exchanger has been frozen. In such a case, it is necessary to provide a temperature sensor to an outlet of the auxiliary heat source, in order to perform feedback control of the apparatus, on the basis of the temperature of the outlet of the auxiliary heat source. However, depending on the configuration of the apparatus, it is sometimes impossible to use a commercially available heater or the like as the auxiliary heat source, and it is compulsory to prepare a dedicated auxiliary heat source for the apparatus. The cost is higher in such a case.

Further, wiring for sending and receiving the detection results from the temperature sensor is a light electrical wire and therefore is prone to be affected by noise. Accordingly, it is necessary to take measures to counteract noise in the wiring for sending and receiving, and a concern is presented in that the size of the apparatus is thereby increased.

In view whereof, the present invention addresses the problem of providing a technology for obviating the need for a temperature sensor at the outlet of the auxiliary heat source.

Solution to Problem

A heat pump system according to a first aspect of the present invention is comprised of a refrigerant circuit, an aqueous medium circuit, an auxiliary heat source, a heating capability computation unit, a circulation flow rate computation unit, and a prediction unit. The refrigerant circuit has a compressor, a heat source-side heat exchanger, and a refrigerant-water heat exchanger. The compressor compresses a refrigerant. The heat source-side heat exchanger is able to function as an evaporator for the refrigerant. The refrigerant-water heat exchanger is able to function as a heat radiator for the refrigerant and to heat an aqueous medium. The aqueous medium circuit has a circulation pump and the refrigerant-water heat exchanger. The aqueous medium, having exchanged heat in the refrigerant-water heat exchanger with the refrigerant, is circulated to the aqueous medium circuit. Further, the aqueous medium circuit is connected to an aqueous medium device for using the aqueous medium to perform an operation. The auxiliary heat source is provided in the aqueous medium circuit to an aqueous medium outlet side of the refrigerant-water heat exchanger and is able to further heat the aqueous medium circulating in the aqueous medium circuit. The heating capability computation unit computes a heating capability of the aqueous medium device on the basis of an operating state quantity of a constituent device or the refrigerant flowing through the refrigerant circuit. The circulation flow rate computation unit computes a circulation flow rate of the aqueous medium in the aqueous medium circuit, on the basis of the heating capability and an outlet/inlet/temperature difference. The "outlet/inlet temperature difference" refers to the difference between an inlet temperature and an outlet temperature of the aqueous medium in the refrigerant-water heat exchanger. The prediction unit predicts the outlet temperature of the aqueous medium in the auxiliary heat source in a case where the auxiliary heat source has acted, on the basis of the circulation flow rate and of heat source capability information indicative of the capability of the auxiliary heat source.

According to this heat pump system, the circulation flow rate of the aqueous medium in the aqueous medium circuit is computed on the basis of the outlet/inlet temperature difference of the aqueous medium in the refrigerant-water heat exchanger and on the heating capability of the aqueous medium device having been obtained by computation, the outlet temperature of the aqueous medium in the auxiliary heat source is predicted on the basis of this computation result as well as of the heat source capability information indicative of the capability of the auxiliary heat source. Accordingly, even without the provision of a temperature sensor near the outlet of the auxiliary heat source, it is possible to know the outlet temperature of the aqueous medium in the auxiliary heat source.

A heat pump system according to a second aspect of the present invention is the heat pump system according to the first aspect of the present invention, wherein the circulation pump is a variable capacity-type pump. The circulation flow rate computation unit computes a circulation flow rate at the most recent rotational speed of the acting circulation pump.

According to this heat pump system, the variable-capacity-type pump is used as the circulation pump in the aqueous medium circuit. This makes it possible to ensure a suitable amount of flow rate of the aqueous medium circulating through the aqueous medium circuit. Also, with this heat pump system, the circulation flow rate at the current rotational speed of the circulation pump in the aqueous medium circuit is computed on the basis of the outlet/inlet temperature difference and the heating capability, and the circulation flow rate is used in the prediction of the outlet temperature of the aqueous medium. This makes it possible to more accurately predict the actual outlet temperature.

A heat pump system according to a third aspect of the present invention is the heat pump system according to the second aspect of the present invention, further provided with a pump capacity controller. When the auxiliary heat source begins to act, the pump capacity controller performs a control for allowing the capacity of the circulation pump to vary such that the flow rate of the aqueous medium in the aqueous medium circuit reaches a rated flow rate or maximum flow rate of the circulation pump.

According to this heat pump system, when the auxiliary heat source acts, the flow rate of the aqueous medium reaches a maximum. Accordingly, after the aqueous medium having a flow rate reaching the rated flow rate or maximum flow rate of the circulation pump has been heated by the refrigerant-water heat exchanger, the aqueous medium will be further heated by the auxiliary heat source.

A heat pump system according to a fourth aspect of the present invention is the heat pump system according to any of the first through third aspects of the present invention, wherein the compressor is a variable-capacity-type compressor. Also, the heat pump system is further provided with a heat source operation controller. The heat source operation controller causes the auxiliary heat source to perform an operation in a case where the capacity of the compressor is a predetermined capacity or higher and where an outlet-side temperature difference, which is the difference between a target outlet temperature and the outlet temperature of the aqueous medium in the refrigerant-water heat exchanger, is a first predetermined temperature difference or higher.

According to this heat pump system, the auxiliary heat source performs an operation in the case where the capacity of the compressor is the predetermined capacity or higher and where the outlet-side temperature difference of the aqueous medium in the refrigerant-water heat exchanger is the first predetermined temperature difference or higher. Thereby, even in a case where, with only heating of the aqueous medium by the refrigerant-water heat exchanger, the temperature of the aqueous medium does not reach a desired temperature, further heating by the auxiliary heat source will cause the aqueous medium device to be supplied with aqueous medium of the desired temperature.

A heat pump system according to a fifth aspect of the present invention is the heat pump system according to the fourth aspect of the present invention, wherein, in a state where the auxiliary heat source is operating, the heat source operation controller discontinues the operation of the auxiliary heat source in a case where the outlet-side temperature difference is a second predetermined temperature difference or lower, the second predetermined temperature difference being lower than the first predetermined temperature difference.

According to this heat pump system, the auxiliary heat source discontinues operation in a case where the outlet-side temperature difference is the second predetermined temperature difference or lower, the second predetermined temperature difference being lower than the first predetermined temperature difference, i.e., in a case where the outlet temperature of the aqueous medium in the refrigerant-water heat exchanger is close to the target outlet temperature, because the aqueous medium device has obtained the aqueous medium of the desired temperature and there is no need for the auxiliary heat source to be made to operate any further. This makes it possible to prevent power consumption caused by unnecessary operation of the auxiliary heat source.

A heat pump system according to a sixth aspect of the present invention is the heat pump system according to the fifth aspect of the present invention, wherein the first predetermined temperature difference and the second predetermined temperature difference are determined on the basis of the prediction result from the prediction unit.

According to this heat pump system, the first predetermined temperature difference and the second predetermined temperature difference are variables determined on the basis of the predicted outlet temperature of the aqueous medium in the auxiliary heat source. This makes it possible for the outlet temperature difference to be compared with a first predetermined temperature and second predetermined temperature, which are changed depending on the outlet temperature of the aqueous medium in the auxiliary heat source as predicted from time to time, whereby the operation of the auxiliary heat source can be begun or discontinued as appropriate.

A heat pump system according to a seventh aspect of the present invention is a heat pump system according to any of the fourth through sixth aspects of the present invention, wherein the heat source operation controller discontinues the operation of the auxiliary heat source irrespective of the operation capacity of the compressor in a case where the aqueous medium device fails or is forcibly prohibited from operating in the state where the auxiliary heat source is operating.

According to this heat pump system, the operation of the auxiliary heat source is forcibly discontinued in the case where the aqueous medium device fails or is forcibly prohibited from operating. The aqueous medium will thereby not continue to be further heated by the operation of the auxiliary heat source when the aqueous medium device fails or is prohibited from operating. Accordingly, it is possible to prevent an accident or the like and/or further failure of the heat pump system caused with the auxiliary heat source as a factor. It is also possible to keep low the power consumed by the operation of the auxiliary heat source.

A heat pump system according to an eighth aspect of the present invention is the heat pump system according to any of the fourth through seventh aspects of the present invention, wherein the heat source operation controller discontinues the operation of the auxiliary heat source in a case where the inlet temperature of the aqueous medium in the refrigerant-water heat exchanger is a predetermined temperature or higher in the state where the auxiliary heat source is operating.

As has already been described, the outlet temperature of the aqueous medium in the auxiliary heat source is predicted using the computed heating capability of the aqueous medium device and/or the computed circulation flow rate of the aqueous medium or the like, but, depending on the case, a concern is presented in that the prediction result may be different from the actual outlet temperature of the aqueous medium. In view whereof, according to this heat pump system, the operation of the auxiliary heat source is discontinued where necessary while the temperature of the aqueous medium coming back to the refrigerant-water heat exchanger, i.e., the inlet temperature of the aqueous medium in the refrigerant-water heat exchanger, is also being monitored. Thereby, even in a case where the prediction result might be different from the actual outlet temperature of the aqueous medium, the operation of the auxiliary heat source will be controlled as appropriate on the basis of the inlet temperature of a water heat source.

A heat pump system according to a ninth aspect of the present invention is the heat pump system according to any of the first through eighth aspects of the present invention, wherein the auxiliary heat source is a variable-capacity-type heat source. Also, the heat pump system is further provided with an accepting unit able to accept a setting for the capacity of the auxiliary heat source.

According to this heat pump system, the capacity of the auxiliary heat source can be changed by, for example, a remote controller or other device to which the accepting unit has been provided. This makes it possible to appropriately vary the capacity of an auxiliary heat source as appropriate in accordance with, e.g., the circumstances of the power source used in the country in which the heat pump system is installed.

Advantageous Effects of Invention

The following advantageous effects are obtained according to the present invention as has been described above.

According to the heat pump system according to the first aspect of the present invention, even without the provision of a temperature sensor near the outlet of the auxiliary heat source, it is possible to know the outlet temperature of the aqueous medium in the auxiliary heat source.

According to the heat pump system according to the second aspect of the present invention, it is possible to ensure a suitable amount of flow rate of the aqueous medium circulating through the aqueous medium circuit. Further, according to this heat pump system, it is possible to more accurately predict the actual outlet temperature.

According to the heat pump system according to the third aspect of the present invention, after the aqueous medium having a flow rate reaching the rated flow rate or maximum flow rate of the circulation pump has been heated by the refrigerant-water heat exchanger, the aqueous medium will be further heated by the auxiliary heat source.

According to the heat pump system according to the fourth aspect of the present invention, even in a case where, with only heating of the aqueous medium by the refrigerant-water heat exchanger, the temperature of the aqueous medium does not reach a desired temperature, further heating by the auxiliary heat source will cause the aqueous medium device to be supplied with aqueous medium of the desired temperature.

According to the heat pump system according to the fifth aspect of the present invention, it is possible to prevent power consumption caused by unnecessary operation of the auxiliary heat source.

According to the heat pump system according to the sixth aspect of the present invention, it is possible for the outlet temperature difference to be compared with a first predetermined temperature and second predetermined temperature, which are changed depending on the outlet temperature of the aqueous medium in the auxiliary heat source as predicted from time to time, whereby the operation of the auxiliary heat source can be begun or discontinued as appropriate.

With the heat pump system according to the seventh aspect of the present invention, it is possible to prevent further failure or the like of the heat pump system caused with the auxiliary heat source as a factor. It is also possible to keep low the power consumed by the operation of the auxiliary heat source.

According to the heat pump system according to the eighth aspect of the present invention, even in a case where the prediction result is different from the actual outlet temperature of the aqueous medium, the operation of the auxiliary heat source will be controlled as appropriate on the basis of the inlet temperature of a water heat source.

With the heat pump system according to the ninth aspect of the present invention, it is possible to vary the capacity of an auxiliary heat source as appropriate in accordance with, e.g., the circumstances of the power source used in the country in which the heat pump system is installed.

DESCRIPTION OF EMBODIMENTS

An embodiment of a heat pump system according to the present invention is described hereinbelow on the basis of the accompanying drawings.

<Configuration>

—Entire Structure—

Figure 1:
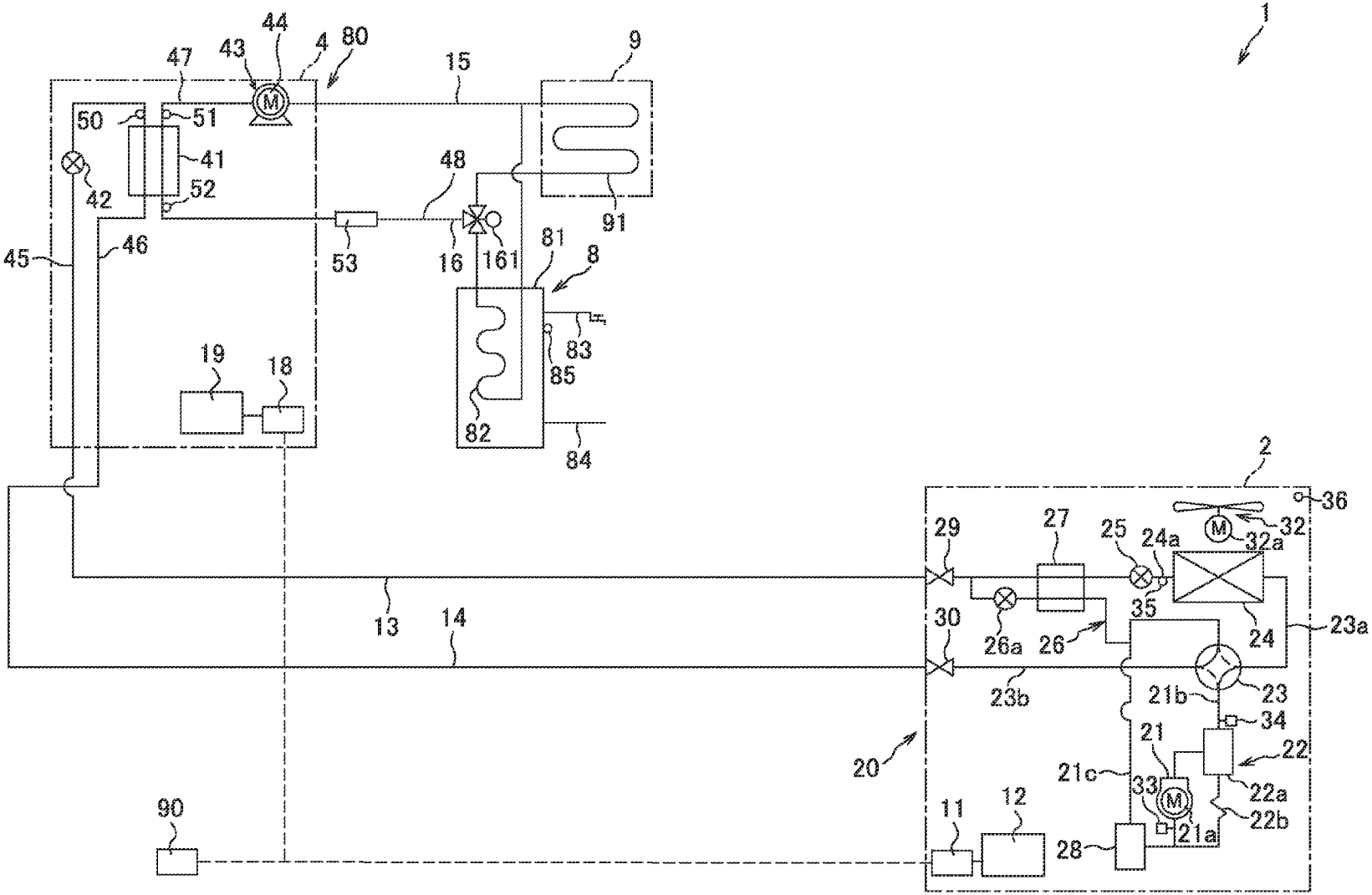
FIG. 1 is a schematic configuration view of a heat pump system according to a present embodiment.

FIG. 1 is a rough schematic configuration view of a heat pump system 1 according to one embodiment of the present invention. The heat pump system 1 is an apparatus capable of performing an operation, for example, for heating an aqueous medium, by using a vapor compressor-type heat pump cycle.

The heat pump system 1 comprises primarily a heat source unit 2, a usage unit 4, a liquid refrigerant interconnecting tube 13, a gas refrigerant interconnecting tube 14, a hot-water storage unit 8, a warm-water heating unit 9, aqueous medium interconnecting tubes 15, 16, an auxiliary heat source 53, a heat source-side correspondence unit 11, a heat source-side controller 12, a usage-side correspondence unit 18, a usage-side controller 19, and a remote controller 90. The heat source unit 2 and the usage unit 4 are connected to each other via the liquid refrigerant interconnecting tube 13 and the gas refrigerant interconnecting tube 14, and a heat source-side refrigerant circuit 20 is constituted thereby. The heat source-side refrigerant circuit 20 is constituted (primarily of a heat source-side compressor 21 (described below), a heat source-side heat exchanger 24 (described below), and a usage-side heat exchanger 41 (described below; equivalent to a refrigerant-water heat exchanger). The usage unit 4, the hot-water storage unit 8, and the warm-water heating unit 9 are connected by the aqueous medium interconnecting tubes 15, 16, whereby an aqueous medium circuit 80 is constituted. The aqueous medium circuit 80 is constituted primarily of a circulation pump 43 (described below) and the usage-side heat exchanger 41 (described below).

HFC-410A, which is a type of hydrofluorocarbon (HFC-) based refrigerant, is enclosed inside the heat source-side refrigerant circuit 20; also enclosed is an ester-based or ether-based refrigerating machine oil, compatible with the HFC-based refrigerant, in order to lubricate the heat source-side compressor 21 (described below). The aqueous medium (specifically, hot water) after having exchanged heat using the usage-side heat exchanger 41 (described below) is circulated to the aqueous medium circuit 80.

—Heat Source Unit—

The heat source unit 2 is installed outdoors. The heat source unit 2 is connected to the usage-side unit 4 via the liquid refrigerant interconnecting tube 113 and the gas refrigerant interconnecting tube 14, and the heat source unit 2 constitutes part of the heat source-side refrigerant circuit 20.

The heat source unit 2 has primarily the heat source-side compressor 21, an oil separation mechanism 22, a heat source-side switching mechanism 23, the heat source-side heat exchanger 24, a heat source-side expansion valve 25, an intake return tube 26, a supercooler 27, a heat source-side accumulator 28, a liquid-side shut-off valve 29, and a gas-side shut-off valve 30.

The heat source-side compressor 21 is a mechanism for compressing the heat source-side refrigerant, and is a variable-capacity-type compressor. Specifically, it is a hermetic-type compressor wherein a rotary-type, scroll-type, or other volume-type compression element (not shown) housed within a casing (not shown) is driven by a heat source-side compression motor 21*a* housed within the same casing. Inside the casing of the heat source-side compressor 21 is formed a high-pressure space (not shown) in which the heat source-side refrigerant fills after being compressed in the compression element, and refrigerating machine oil is accumulated in this high-pressure space. The heat source-side compression motor 21*a* can vary the rotational speed (i.e., the operating frequency) of the motor 21*a* by an inverter device (not shown), whereby the capacity of the heat source-side compressor 21 can be controlled.

The oil separation mechanism 22 is a mechanism for separating the refrigerating machine oil contained in the heat source-side refrigerant discharged from the heat source-side compressor 21 and returning the oil to the intake of the heat source-side compressor. The oil separation mechanism 22 has primarily an oil separator 22*a* provided to a heat source-side discharge tube 21*b* of the heat source-side compressor 21, and an oil return tube 22*b* for connecting the oil separator 22*a* and a heat source-side intake tube 21*c* of the heat source-side compressor 21. The oil separator 22*a* is a device for separating the refrigerating machine oil contained in the heat source-side refrigerant discharged from the heat source-side compressor 21. The oil return tube 22*b* has a capillary tube. The oil return tube 22*b* is a refrigerant tube for returning the refrigerating machine oil separated from the heat source-side refrigerant in the oil separator 22*a* to the heat source-side intake tube 21*c* of the heat source-side compressor 21.

The heat source-side switching mechanism 23 is a four-way switching valve capable of switching between a heat source-side heat-radiating operation state in which the heat source-side heat exchanger 24 is made to function as a radiator of the heat source-side refrigerant, and a heat source-side evaporating operation state in which the heat source-side heat exchanger 24 is made to function as an evaporator of the heat source-side refrigerant. The heat source-side switching mechanism 23 is connected to the heat source-side discharge tube 21*b*, the heat source-side intake tube 21*c*, a first heat source-side gas refrigerant tube 23*a* connected to the gas side of the heat source-side heat exchanger 24, and a second heat source-side gas refrigerant tube 23*b* connected to the gas-side shut-off valve 30. The heat source-side switching mechanism 23 is capable of switching between an action of which the heat source-side discharge tube 21*b* communicates with the first heat source-side gas refrigerant tube 23*a* and the second heat source-side gas refrigerant tube 23*b* communicates with the heat source-side intake tube 21*c* (equivalent to the heat source-side heat-radiating state, refer to the solid lines of the heat source-side switching mechanism 23 in FIG. 1), and another action of which the heat source-side discharge tube 21*b* communicates with the second heat source-side gas refrigerant tube 23*b* and the first heat source-side gas refrigerant tube 23*a* communicates with the heat source-side intake tube 21*c* (equivalent to the heat source-side evaporating operation state, refer to the dashed lines of the heat source-side switching mechanism 23 in FIG. 1).

The heat source-side switching mechanism 23 is not limited to a four-way switching valve, and may be configured so as to have a function for switching the flow direction of the same heat source-side refrigerant as is described above by combining a plurality of electromagnetic valves, for example.

The heat source-side heat exchanger 24 is a heat exchanger which functions as a radiator or an evaporator of the heat source-side refrigerant by performing heat exchange between the heat source-side refrigerant and outdoor air. A heat source-side liquid refrigerant tube 24*a* is connected to the liquid side of the heat source-side heat exchanger 24, and the first heat source-side gas refrigerant tube 23*a* is connected to the gas side of the heat source-side heat exchanger 24. The outdoor air that undergoes heat exchange with the heat source-side refrigerant in the heat source-side heat exchanger 24 is supplied by a heat source-side fan 32 driven by a heat source-side fan motor 32*a*.

The heat source-side expansion valve 25 is an electric expansion valve for depressurizing or otherwise treating the heat source-side refrigerant flowing through the heat source-side heat exchanger 24, and is provided to the heat source-side liquid refrigerant tube 24*a*.

The intake return tube 26 is a refrigerant tube for branching off some of the heat source-side refrigerant flowing through the heat source-side liquid refrigerant tube 24*a* and returning the refrigerant to the intake of the heat source-side compressor 21. One end of the intake return tube 26 is connected to the heat source-side liquid refrigerant tube 24*a*, and the other end of the tube 26 is connected to the heat source-side intake tube 21*c*. An intake return expansion valve 26*a* whose opening degree can be controlled is provided to the intake return tube 26. The intake return expansion valve 26*a* is configured from an electric expansion valve.

The supercooler 27 is a heat exchanger that performs heat exchange between the heat source-side refrigerant flowing through the heat source-side liquid refrigerant tube 24*a* and the heat source-side refrigerant flowing through the intake return tube 26 (more specifically, the refrigerant that has been depressurized by the intake return expansion valve 26*a*).

The heat source-side accumulator 28 is provided to the heat source-side intake tube c, and is a container for primarily accumulating the heat source-side refrigerant circulating through the heat source-side refrigerant circuit 20 before the refrigerant is drawn from the heat source-side intake tube 21*c* into the heat source-side compressor 21.

The liquid-side shut-off valve 29 is a valve provided to the connecting portion between the heat source-side liquid refrigerant tube 24*a* and the liquid refrigerant interconnecting tube 13. The gas-side shut-off valve 30 is a valve provided to the connecting portion between the second heat source-side gas refrigerant tube 23*b* and the gas refrigerant interconnecting tube 14.

Various sensors are provided to the heat source unit 2. Specifically, the heat source unit 2 is provided with a heat source-side intake pressure sensor 33, a heat source-side discharge pressure sensor 34, a heat source-side heat exchange temperature sensor 35, and an outdoor air temperature sensor 36. The heat source-side intake pressure sensor 33 detects the heat source-side intake pressure Ps, which is the pressure of the heat source-side refrigerant being drawn into the heat source-side compressor 21. The heat source-side discharge pressure sensor 34 detects the heat source-side discharge pressure Pd, which is the pressure of the heat source-side refrigerant being discharged from the heat source-side compressor 21. The heat source-side heat exchange temperature sensor 35 detects the heat source-side heat exchanger temperature Thx, which is the temperature of the heat source-side refrigerant in the liquid side of the heat source-side heat exchanger 24. The outdoor air temperature sensor 36 detects the outdoor air temperature To.

—Liquid Refrigerant Interconnecting Tube—

The liquid refrigerant interconnecting tube 13 is connected to the heat source-side liquid refrigerant tube 24*a* via the liquid-side shut-off valve 29. The liquid refrigerant interconnecting tube 13 is a refrigerant tube capable of leading the heat source-side refrigerant out of the heat source unit 2 through the outlet of the heat source-side heat exchanger 24 functioning as a radiator of the heat source-side refrigerant when the heat source-side switching mechanism 23 is in the heat source-side heat-radiating operation state. The liquid refrigerant interconnecting tube 13 is a refrigerant tube capable of leading the heat source-side refrigerant from the exterior of the heat source unit 2 into the inlet of the heat source-side heat exchanger 24 functioning as an evaporator of the heat source-side refrigerant when the heat source-side switching mechanism 23 is in the heat source-side evaporating operation state.

—Gas Refrigerant Interconnecting Tube—

The gas refrigerant interconnecting tube 14 is connected to the second heat source-side gas refrigerant tube 23*b* via the gas-side shut-off valve 30. The gas refrigerant interconnecting tube 14 is a refrigerant tube capable of leading the heat source-side refrigerant into the intake side of the heat source-side compressor 21 from the exterior of the heat source unit 2 when the heat source-side switching mechanism 23 is in the heat source-side heat-radiating operation state. The gas refrigerant interconnecting tube 14 is also a refrigerant tube capable of leading the heat source-side refrigerant out of the heat source unit 2 through the discharge side of the heat source-side compressor 21 when the heat source-side switching mechanism 23 is in the heat source-side evaporating operation state.

—The Usage Unit—

The usage unit 4 is installed indoors. The usage unit 4 is connected to the heat source unit 2 via the liquid refrigerant interconnecting tube 13 and the gas refrigerant interconnecting tube 114, and constitutes part of the heat source-side refrigerant circuit 20. The usage unit 4 is also connected to the hot-water storage unit 8 and to the warm-water heating unit 9 via the aqueous medium interconnecting tubes 15, 16, and the aqueous medium circuit 80 is constituted within this unit 4.

The usage unit 4 is able to perform an operation for heating the aqueous medium during a heating operation and during a hot water supply operation. The usage unit 4 primarily has the usage-side heat exchanger 41, a usage-side flow rate adjustment valve 42, and the circulation pump 43.

The usage-side heat exchanger 41 performs heat exchange between the heat source-side refrigerant and the aqueous medium. Specifically, the usage-side heat exchanger 41 is able to function as a heat radiator of the heat source-side refrigerant during the heating operation and during the hot water supply operation, thereby performing heat exchange between the heat source-side refrigerant and the aqueous medium, and heating the aqueous medium. Within the usage-side heat exchanger 41, a usage-side refrigerant tube 45 is connected to the liquid side of the flow passage through which the heat source-side refrigerant flows, and a usage-side refrigerant tube 46 is connected to the gas side of the flow passage through which the heat source-side refrigerant flows. Also within the usage-side heat exchanger 41, a usage-side water inlet tube 47 is connected to the inlet side of the flow passage through which the aqueous medium flows and a usage-side water outlet tube 48 is connected to the outlet side of the flow passage through which the aqueous medium flows. The liquid refrigerant interconnecting tube 13 is connected to the usage-side refrigerant tube 45, and the gas refrigerant interconnecting tube 14 is connected to the usage-side refrigerant tube 46. The aqueous medium interconnecting tube 15 is connected to the usage-side water inlet tube 47, and the aqueous medium interconnecting tube 16 is connected to the usage-side water outlet tube 48.

The usage-side flow rate adjustment valve 42 is an electronic expansion valve capable of varying the flow rate of the heat source-side refrigerant flowing through the usage-side heat exchanger 41, through self-adjustment of the opening degree of the adjustment valve 42. The usage-side flow rate adjustment valve 42 is connected to the usage-side refrigerant tube 45.

The circulation pump 43 is a mechanism for pressurizing the aqueous medium, and is provided to the usage-side water inlet tube 47. Specifically, a pump in which a centrifugal or volume-type pump element (not shown) is driven by a circulation pump motor 44, is used as the circulation pump 43. An inverter device (not shown) can be used to vary the rotational speed (i.e., the operation frequency) of the circulation pump motor 44 to individually different rotational speeds, whereby the capacity of the circulation pump 43 can be controlled.

Various sensors are also provided to the usage unit 4. Specifically, the usage unit 4 is provided with a usage-side heat exchange temperature sensor 50, an aqueous medium inlet temperature sensor 51, and an aqueous medium outlet temperature sensor 52. The usage-side heat exchange temperature sensor 50 detects a usage-side refrigerant temperature Tsc1, which is the temperature of the heat source-side refrigerant in the liquid side of the usage-side heat exchanger 41. The aqueous medium inlet temperature sensor 51 detects an inlet temperature Twr, which is the temperature of the aqueous medium in the inlet of the usage-side heat exchanger 41. The aqueous medium outlet temperature sensor 52 detects an aqueous medium outlet temperature Twl, which is the temperature of the aqueous medium in the outlet of the usage-side heat exchanger 41.

—The Hot-Water Storage Unit—

The hot-water storage unit 8 is an aqueous medium device for using the aqueous medium supplied from the usage unit 4 to perform an operation, and is installed indoors. The hot-water storage unit 8 is connected to the usage unit 4 via the aqueous medium interconnecting tubes 15, 16, and is thereby connected to the aqueous medium circuit 80.

The hot-water storage unit 8 primarily has a hot-water storage tank 81 and a heat exchange coil 82.

The hot-water storage tank 81 is a container for accumulating water as the aqueous medium supplied for the hot water supply. Connected to an upper part of the hot-water storage tank 81 is a hot water supply tube 83 for feeding the aqueous medium, having become warm water, to a faucet, a shower, or the like, and connected to a bottom part thereof is a water supply tube 84 for replenishing the aqueous medium that has been consumed by the hot water supply tube 83.

The heat exchange coil 82 is provided inside the hot-water storage tank 81. The heat exchange coil 82 is a heat exchanger which functions as a heater of the aqueous medium in the hot-water storage tank 81, by performing heat exchange between the aqueous medium circulating through the aqueous medium circuit 80 and the aqueous medium in the hot-water storage tank 81. The aqueous medium interconnecting tube 16 is connected to an inlet of the heat exchange coil 82, and the aqueous medium interconnecting tube 15 is connected to an outlet of the heat exchange coil 82.

The hot-water storage unit 8 is thereby capable of using the aqueous medium circulating through the aqueous medium circuit 80, heated in the usage unit 4, to heat the aqueous medium in the hot-water storage tank 81 and accumulate the aqueous medium as warm water during the hot water supply operation and during the heating operation. Herein, the type of hot-water storage unit used as the hot-water storage unit 8 is one that accumulates in a hot-water storage tank the aqueous medium heated by heat exchange with the aqueous medium heated in the usage unit 4, but another type that also may be used is a hot-water storage unit that accumulates in a hot-water storage tank the aqueous medium heated in the usage-side unit 4.

Various sensors are provided to the hot-water storage unit 8. Specifically, the hot-water storage unit 8 is provided with a hot-water storage temperature sensor 85 for detecting a hot-water storage temperature Twh, which is the temperature of the aqueous medium accumulated in the hot-water storage tank 81.

—The Warm-Water Heating Unit—

The warm-water heating unit 9 is an aqueous medium device that uses the aqueous medium supplied from the usage unit 4 to perform a heating operation, and is installed indoors. The warm-water heating unit 9 is connected to the usage unit 4 via the aqueous medium interconnecting tubes 15, 16, and is thereby connected to the aqueous medium circuit 80.

The warm-water heating unit 9 primarily has a heat exchange panel 91 and constitutes a convector, a floor heating panel, a radiator, or the like.

The heat exchange panel 91 is provided to an indoor wall or the like in the case of the convector or radiator, and is provided under an indoor floor or the like in the case of the floor heating panel. The heat exchange panel 91 is a heat exchanger which functions as a heat radiator of the aqueous medium circulating through the aqueous medium circuit 80. The aqueous medium interconnecting tube 16 is connected to an inlet of the heat exchange panel 91, and the aqueous medium interconnecting tube 15 is connected to an outlet of the heat exchange panel 91.

—Aqueous Medium Interconnecting Tubes—

The aqueous medium interconnecting tube 15 is connected to the outlet of the heat exchange coil 82 of the hot-water storage unit 8 and to the outlet of the heat exchange panel 91 of the warm-water heating unit 9. The aqueous medium interconnecting tube 16 is connected to the inlet of the heat exchange coil 82 of the hot-water storage unit 8 and to the inlet of the heat exchange panel 91 of the warm-water heating unit 9. The aqueous medium interconnecting tube 16 is provided with an aqueous medium-side switching mechanism 161 capable of switching between supplying the aqueous medium circulating through the aqueous medium circuit 80 to both the hot-water storage unit 8 and the warm-water heating unit 9, and supplying the aqueous medium either one of the hot-water storage unit 8 and the warm-water heating unit 9. This aqueous medium-side switching mechanism 161 is configured from a three-way valve.

—The Auxiliary Heat Source—

The auxiliary heat source 53 is provided in the aqueous medium circuit 80 on an aqueous medium outlet side of the usage-side heat exchanger 41, more specifically, on the aqueous medium interconnecting tube 16, and is able to further heat the aqueous medium which is heated by the usage-side heat exchanger 41 and circulates over the aqueous medium circuit 80. In particular, the auxiliary heat source 53 according to the present embodiment is a heat source, the capacity of which (for example, 3 kW, 12 kW, or the like) can be changed; a specific example thereof includes an auxiliary heater. The auxiliary heat source 53 is detachably provided to the aqueous medium interconnecting tube 16. For this reason, the auxiliary heat source 53 can be mounted externally on the usage unit 4 during the installation of the heat pump system 1.

—The Heat Source-Side Correspondence Unit

Figure 2:
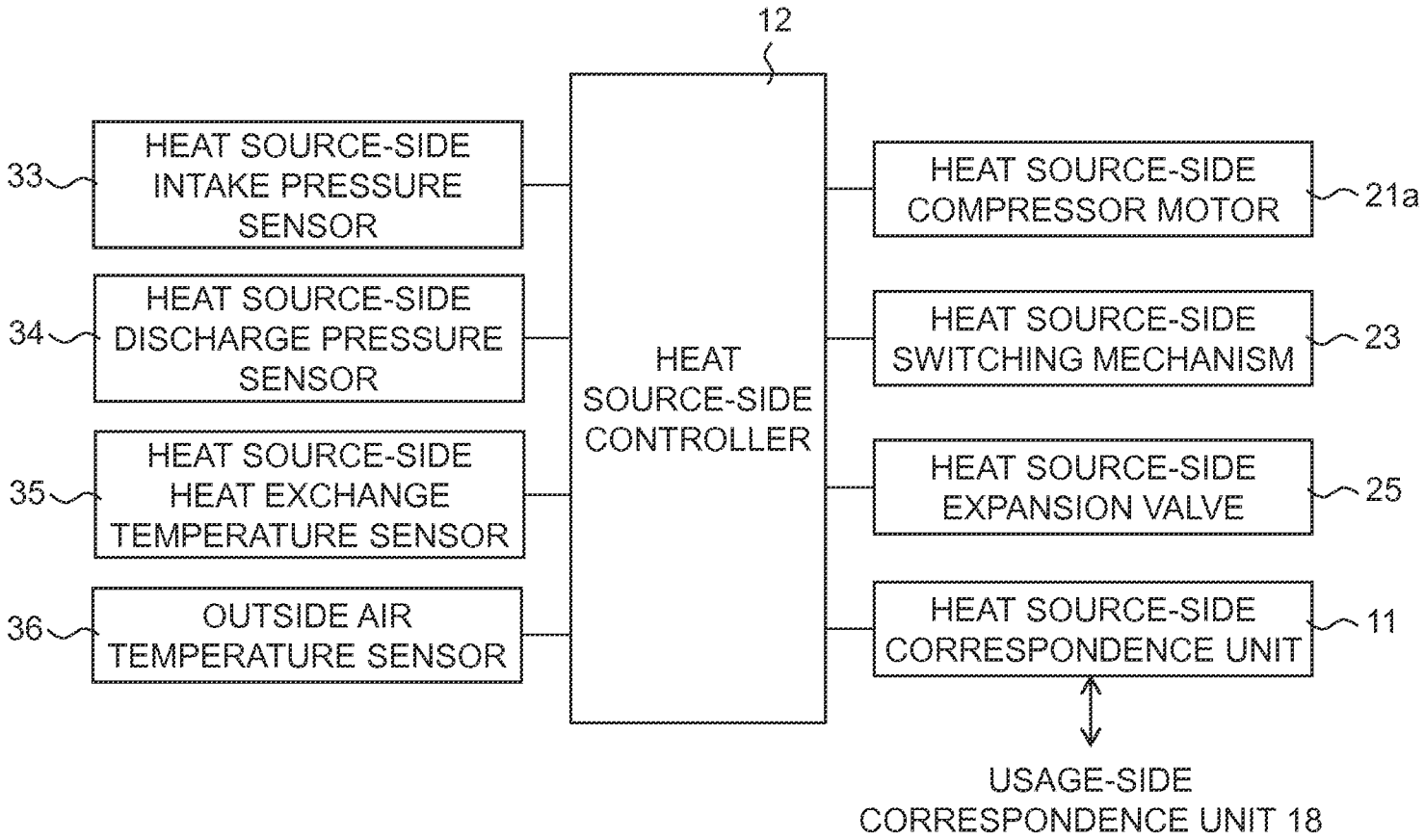
FIG. 2 is a drawing for schematically illustrating a heat source-side controller according to the present embodiment, as well as various sensors and various devices connected to the controller.

The heat source-side correspondence unit 11 is electrically connected to the heat source-side controller 12, as illustrated in FIGS. 1 and 2, and is provided within the heat source unit 2. The heat source-side correspondence unit 11 is electrically connected to the usage-side correspondence unit 18. The heat source-side correspondence unit 11 is capable of receiving from the usage-side correspondence unit 18, and sending to the usage-side correspondence unit 18, various items of information and various forms of data or the like relating to the operating state and control of the heat pump system 1.

In particular, the heat source-side correspondence unit 11 according to the present embodiment is able to send, to the usage-side correspondence unit 18, an operating state quantity of the constituent devices or the refrigerant flowing through the heat source-side refrigerant circuit 20, or the like. Herein, examples of the operating state quantity include: the rotational speed of the heat source-side compressor 21; a heat source-side discharge pressure Pd, which is the detection result from the heat source-side discharge pressure sensor 34; or actuator operating information, which is operating electrical current value of the various devices constituting the heat source-side refrigerant circuit 20.

—The Heat Source-Side Controller—

The heat source-side controller 12 is a microcomputer constituted of a CPU and/or memory and the like, and is provided within the heat source unit 2. The heat source-side controller 12 as illustrated in FIG. 2, is connected to the heat source-side compressor motor 21*a*, the heat source-side switching mechanism 23, the heat source-side expansion valve 25, and the various sensors 33-36 belonging to the heat source unit 2. The heat source-side controller 12 controls the various connected devices on the basis of detection results from the various sensors 33-36, and the like. Specifically, the heat source-side controller 12 performs operating capacity control on the heat source-side compressor 21 by controlling the rotational speed (i.e. controlling the operating frequency)

of the heat source-side compressor motor 21*a*, and also performs state switching control on the heat source-side switching mechanism 23 and opening degree control on the heat source-side expansion valve 25. For example, the heat source-side controller 12 controls the operating capacity of the heat source-side compressor 21 in order to bring the condensation temperature of the heat source-side refrigerant to a predetermined condensation target temperature, and switches the state of the heat source-side switching mechanism 23 in accordance with the type of operation of the heat pump system 1.

—The Usage-Side Correspondence Unit—

Figure 3:
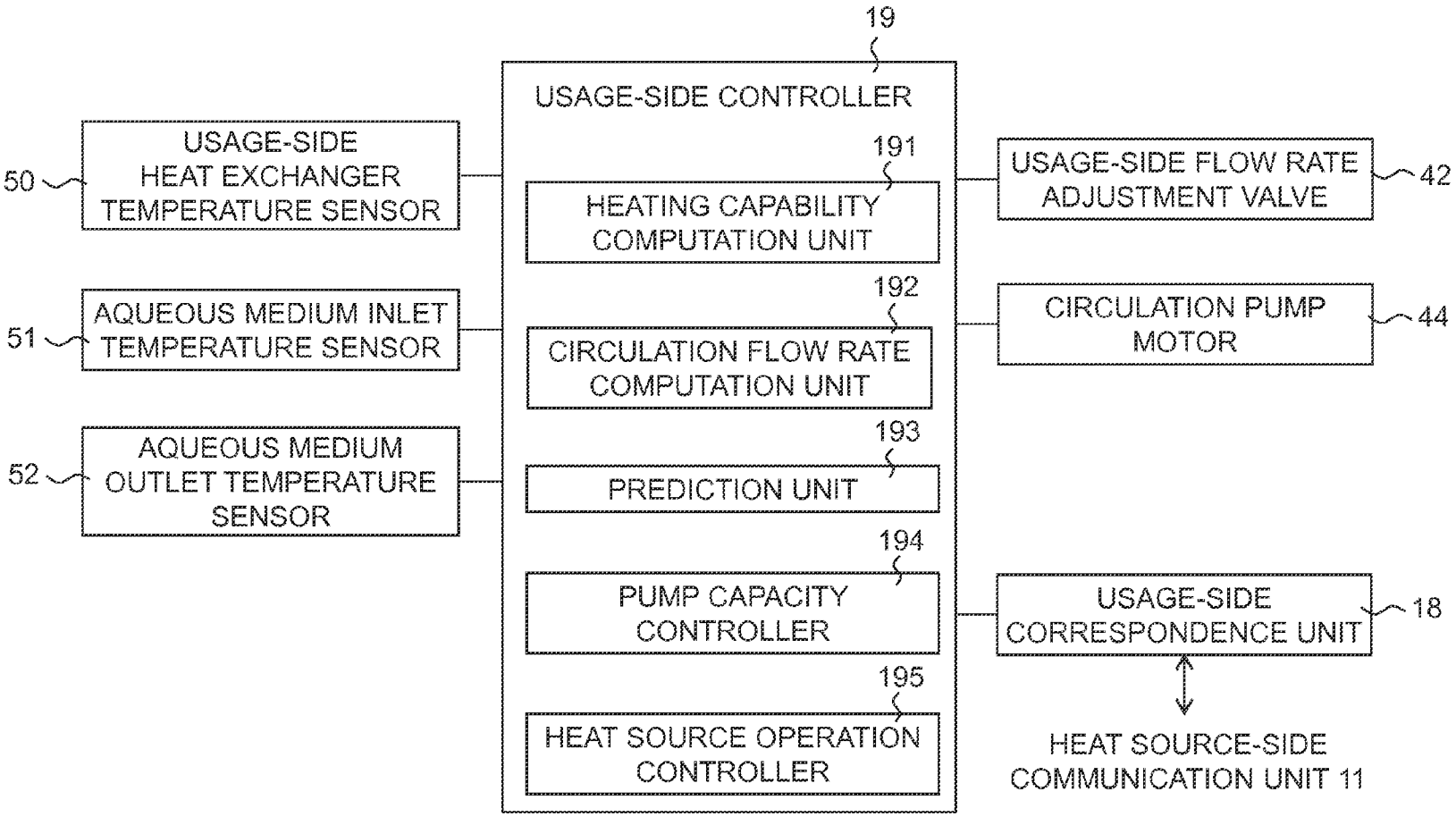
FIG. 3 is a drawing for schematically illustrating a usage-side controller according to the present embodiment, as well as various sensors and various devices connected to the controller.

The usage-side correspondence unit 18 is electrically connected to the usage-side controller 19, as illustrated in FIGS. 1 and 3, and is provided within the usage unit 4. The usage-side correspondence unit 18 is electrically connected to the heat source-side correspondence unit 11. The usage-side correspondence unit 18 is capable of receiving from the heat source-side correspondence unit 11, and sending to the heat source-side correspondence unit 11, various items of information and various forms of data relating to the operating state and control of the heat pump system 1.

In particular, the usage-side correspondence unit 18 according to the present embodiment is able to receive from the heat source-side correspondence unit 11 the aforedescribed operating state quantity of the constituent devices or refrigerant flowing through the heat source-side refrigerant circuit 20.

—The Usage-Side Controller—

The usage-side controller 19 is a microcomputer constituted of a CPU and/or memory and the like, and is provided within the usage unit 4. The usage-side controller 19 is connected to the usage-side flow rate adjustment valve 42, the circulation pump motor 44, and the various sensors 50-52 belonging to the usage unit 4, as illustrated in FIG. 3. The usage-side controller 19 controls the various connected devices on the basis of the detection results from the various sensors 50-52. Specifically, the usage-side controller 19 performs flow rate control on the heat source-side refrigerant by controlling the opening degree of the usage-side flow rate adjustment valve 42, and capacity control on the circulation pump 43 by controlling the rotational speed of the circulation pump motor 44. For example, the usage-side controller 19 performs opening degree control on the usage-side flow rate adjustment valve 42 such that the supercooling degree of the refrigerant becomes constant, in order to stabilize the flow rate of the heat source-side refrigerant in the heat source-side refrigerant circuit 20. The usage-side controller 19 also performs capacity control on the circulation pump 43 such that the temperature difference ΔTw between the outlet temperature Twl and the inlet temperature Twr of the aqueous medium in the usage-side heat exchanger 41 reaches a predetermined temperature difference, in order to bring the flow rate of the aqueous medium in the aqueous medium circuit 80 to an appropriate flow rate.

In particular, the usage-side controller 19 according to the present embodiment predicts the outlet temperature Th1 of the aqueous medium in the auxiliary heat source 53, controls the capacity of the circulation pump 43 in association with the operation of the auxiliary heat source 53, and controls the operation of the auxiliary heat source 53. In order to perform the controls of such description, the usage-side controller 19 functions as a heating capability computation unit 191, a circulation flow rate computation unit 192, a prediction unit 193, a pump capacity controller 194, and a heat source operation controller 195.

—The Heating Capability Computation Unit—

The heating capability computation unit 191 computes the heating capability of the hot-water storage unit 8 and the warm-water heating unit 9, on the basis of the operating state quantity of the constituent devices or of the refrigerant flowing through the heat source-side refrigerant circuit 20, as received by the usage-side correspondence unit 18. Specifically; the heating capability computation unit 191 computes a heating capability Ha of the hot-water storage unit 8 and the warm-water heating unit 9 by using the rotational speed of the heat source-side compressor 21; the heat source-side discharge pressure Pd, which is the detection result from the heat source-side discharge pressure sensor 34; or the actuator operating information, which is the operating electrical current value of the various devices constituting the heat source-side refrigerant circuit 20.

—The Circulation Flow Rate Computation Unit—

The circulation flow rate computation unit 192 computes a circulation flow rate Frw of the aqueous medium in the aqueous medium circuit 80, on the basis of the outlet/inlet temperature difference ΔTw, which is the temperature difference between the inlet temperature Twr and the outlet temperature Twl of the aqueous medium in the usage-side heat exchanger 41, and also of the heating capability Ha computed by the heating capability computation unit 191. More specifically, the circulation flow rate computation unit 192 calculates, as the outlet/inlet temperature difference ΔTw, the difference between the respect detection results Twr, Twl of the aqueous medium inlet temperature sensor 51 and aqueous medium outlet temperature sensor 52, and also detects the current rotational speed rp of the acting circulation pump 43. Further, the circulation flow rate computation unit 192 uses this calculated value ΔTw and the heating capability Ha obtained through computation to compute the circulation flow rate Frw of the aqueous medium at the current rotational speed rp of the acting circulation pump 43.

—The Prediction Unit—

The prediction unit 193 predicts an outlet temperature Th1 of the aqueous medium in the auxiliary heat source 53 in the case where the auxiliary heat source 53 has acted, on the basis of the circulation flow rate Frw of the aqueous medium as computed by the circulation flow rate computation unit 192 and of the heat source capability information the indicative of the capacity of the auxiliary heat source 53. Herein, the heat source capability information the is the capability of the auxiliary heat source 53 to warm the aqueous medium, and is information inputted when the auxiliary heat source 53 is installed (the information is inputted as, for example, "5° C." or the like). By way of one example, the prediction unit 193 multiplies the heat source capability information the and the circulation flow rate Frw of the aqueous medium to thereby predict the outlet temperature Th1 of the aqueous medium in the auxiliary heat source 53.

The outlet temperature Th1 of the aqueous medium in the auxiliary heat source 53 as predicted in this manner is used in the feedback control and the like applied to the operation of the auxiliary heat source 53 (described later).

—The Pump Capacity Controller—

When the auxiliary heat source 53 begins to act, the pump capacity controller 194 performs a control for varying the capacity of the circulation pump 43 such that the flow rate of the aqueous medium in the aqueous medium circuit 80 reaches the rated flow rate or the maximum flow rate of the circulation pump 43. Specifically, when the auxiliary heat source 53 begins to act, the rotational speed of the circulation pump 43 is lifted to the maximum value and the amount of aqueous medium circulating in the aqueous medium circuit 80 reaches a maximum value.

—The Heat Source Operation Controller—

In a case where the capacity of the heat source-side compressor 21 is a predetermined capacity or higher, the heat source operation controller 195 causes the auxiliary heat source 53 to operate in a case where an outlet-side temperature difference ΔTwl, which is the difference between the outlet temperature Twl of the aqueous medium in the usage-side heat exchanger 41 and a target outlet temperature Twls, is a first predetermined temperature difference ΔT1 or higher (a case where ΔTwl=Twls−Twl>ΔT1). In other words, even in a state where the heat pump system 1 is operating such that the operating capacity of the heat source-side compressor 21 reaches an appropriate amount, the aqueous medium outlet temperature Twl in the usage-side heat exchanger 41 functioning as a condenser may not reach the target outlet temperature Twls and the outlet-side temperature difference ΔTwl may be comparatively large, in which case the aqueous medium cannot be heated to the desired temperature in the usage-side heat exchanger 41 alone, and therefore the auxiliary heat source 53 heats the aqueous medium in a complementary manner. For example, when the outlet temperature Twl of the aqueous medium in the usage-side heat exchanger 41 is 53° C. and the target outlet temperature Twls is 60° C., then the outlet-side temperature difference ΔTwl is 8° C. In such a case, when the first predetermined temperature difference ΔT1 is 4° C., then the outlet-side temperature difference ΔTwl reaches the first predetermined temperature difference ΔT1 or higher, and the auxiliary heat source 53 is turned on and heats the aqueous medium. The hot-water storage unit 8 and the warm-water heating unit 9 are thereby supplied with aqueous medium of a higher temperature than the outlet temperature Twl of the aqueous medium in the usage-side heat exchanger 41.

Conversely, the heat source operation controller 195 causes the auxiliary heat source 53 to discontinue operating in a case where the outlet-side temperature difference ΔTwl is a second predetermined temperature difference ΔT2 or lower, the second predetermined temperature difference ΔT2 being lower than the first predetermined temperature difference ΔT1 (ΔTwl<ΔT2<ΔT1), in the state where the auxiliary heat source 53 is operating. When, for example, the outlet temperature Twl of the aqueous medium in the usage-side heat exchanger 41 is 59° C. and the target outlet temperature Tis is 60° C., then the outlet-side temperature difference ΔTwl reaches 1° C. In such a case, when the second predetermined temperature difference ΔT2 is 2° C., then the outlet-side temperature difference ΔTwl reaches the second predetermined temperature difference ΔT2 or lower, and therefore the auxiliary heat source 53 is turned off. Specifically; because the outlet-side temperature difference ΔTwl is comparatively small, it is possible to decide that the heating of the aqueous medium by the usage-side heat exchanger 41 alone is sufficient, and accordingly the auxiliary heat source 53 is turned off. In this manner, in a case where the outlet temperature Twl of the aqueous medium in the usage-side heat exchanger 41 approaches the target outlet temperature Twls, then the hot-water storage unit 8 and the warm-water heating unit 9 have obtained aqueous medium of the desired temperature, and it is no longer necessary to cause the auxiliary heat source 53 to operate any further, wherefore the auxiliary heat source 53 is turned off. The hot-water storage unit 8 and the warm-water heating unit 9 are thereby supplied with aqueous medium having been heated by the usage-side heat exchanger 41.

The aforedescribed first predetermined temperature difference ΔT1 and the second predetermined temperature difference ΔT2 are both variables, and are determined on the basis of the outlet temperature Th1 of the aqueous medium in the auxiliary heat source 53 as predicted by the prediction unit 193. For example, the first predetermined temperature difference ΔT1 and the second predetermined temperature difference ΔT2 are determined by a function expression where the outlet temperature Th1 of the aqueous medium in the auxiliary heat source 53 serves as a variable. The first predetermined temperature difference ΔT1 and the second predetermined temperature difference ΔT2 may be determined by using a table where a theoretical calculation, a simulation, an experiment, or the like are used to represent the relationship between the actual outlet temperature Twl of the aqueous medium in the auxiliary heat source 53 and the first predetermined temperature difference ΔT1 and the second predetermined temperature difference ΔT2 to apply the prediction result Th1 from the prediction unit 193 at the relevant moment.

Specifically, the first predetermined temperature difference ΔT1 and the second predetermined temperature difference ΔT2 according to the present embodiment conceivably define the acting range of the auxiliary heat source 53. Accordingly, the prediction result Th1 of the prediction unit 193 used in the determination of the first predetermined temperature difference ΔT1 and the second predetermined temperature difference ΔT2 is conceivably used in the feedback control of the action of the auxiliary heat source 53.

When the auxiliary heat source 53 is still operating after the hot-water storage unit 8 and the warm-water heating unit 9 have failed or have been forcibly prohibited from operating, the temperature of the aqueous medium, which should no longer be supplied to the hot-water storage unit 8 and the warm-water heating unit 9 (i.e., the warm water), is heated futilely. A concern is presented in that this operation, depending on the case, may cause a failure or accident in the heat pump system 1; moreover, energy is being consumed futilely in the auxiliary heat source 53. In view whereof, the heat source operation controller 195 discontinues the operation of the auxiliary heat source 53 irrespective of the operation capacity of the heat source-side compressor 21 in a case where, when the auxiliary heat source is operating, the hot-water storage unit 8 and the warm-water heating unit 9 fail or are forcibly prohibited from operating. Examples of cases where the hot-water storage unit 8 and the warm-water heating unit 9 are forcibly prohibited from operating include a case where a user has instructed via the remote controller 90 that the operation of the hot-water storage unit 8 and the warm-water heating unit 9 is to be turned off.

Separately from the case where the hot-water storage unit 8 and the warm-water heating unit 9 fail or are forcibly prohibited from operating, the heat source operation controller 195 also discontinues the operation of the auxiliary heat source 53 in a case where the aqueous medium inlet temperature Twr in the usage-side heat exchanger 41 is a predetermined temperature or higher in the state where the auxiliary heat source 53 is operating. For example, in a case where the predetermined temperature is 60° C. and the aqueous medium inlet temperature Twr in the usage-side heat exchanger 41 is 62° C., because the aqueous medium inlet temperature Twr is higher than the predetermined temperature, the operation of the auxiliary heat source 53 is discontinued. This control is adapted to compensate for a case where an error exists in the computation between the heating capability Ha and the circulation flow rate Frw, as obtained by computation, and the actual heating capability and actual circulation flow rate, this error causing the predicted outlet temperature Th1 of the aqueous medium in the auxiliary heat source 53 to be different from the actual outlet temperature.

—The Remote Controller—

Figure 4:
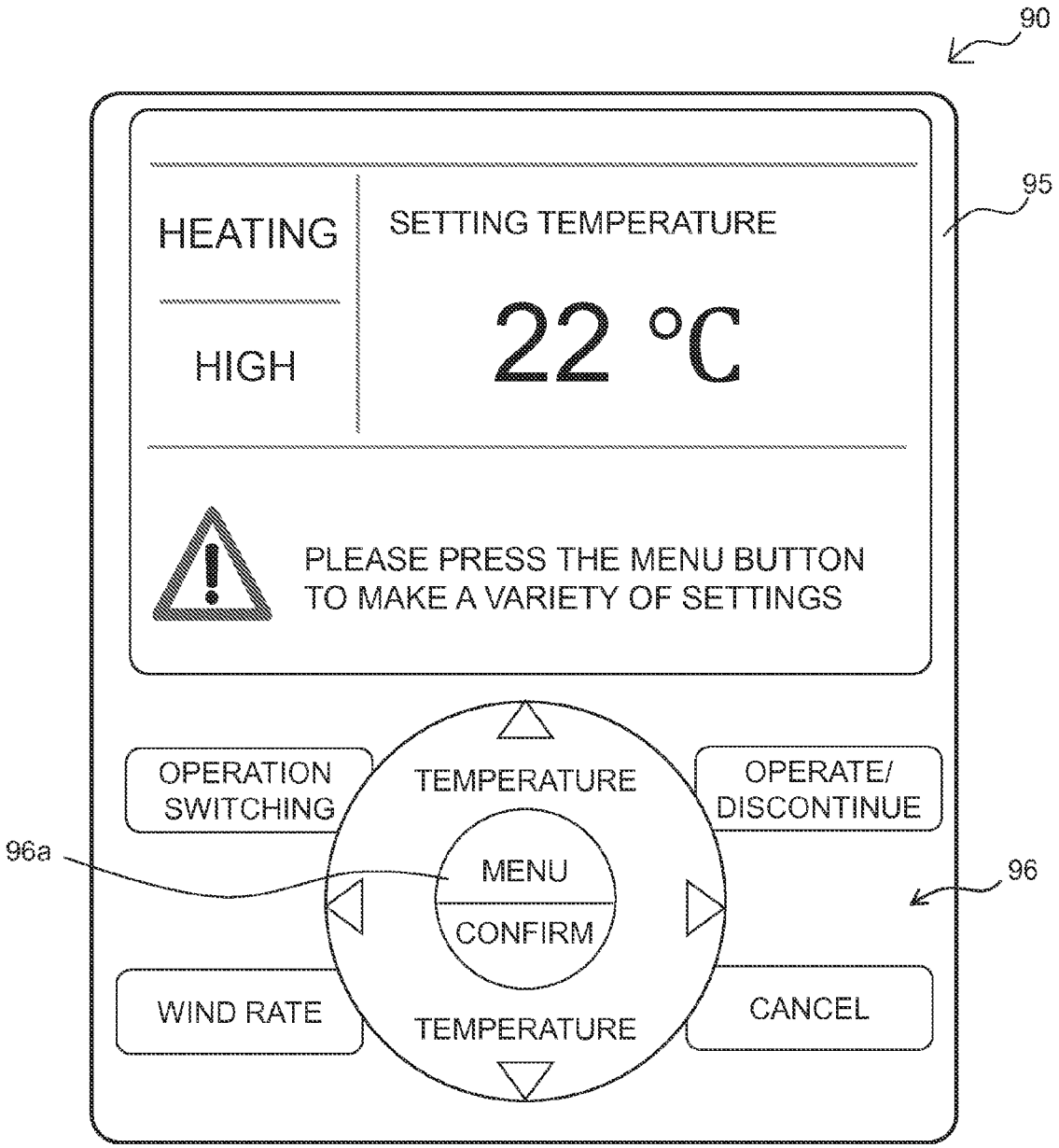
FIG. 4 is an external view of a remote controller according to the present embodiment.

The remote controller 90 is installed indoors, and is connected with the heat source-side correspondence unit 11 and/or the usage-side correspondence unit 18 so as to be capable of communication either via wires or wirelessly, as illustrated in FIG. 1. The remote controller 90 primarily has a display unit 95 and an operating unit 96, as illustrated in FIG. 4. The user can set the temperature of the aqueous medium of the heat pump system 1 and can issue commands relating to various operations via the remote controller 90.

In particular, a menu button 96*a* (equivalent to the accepting unit) is included in the operating unit 96 relating to the remote controller 90 of the present embodiment. This menu button 96*a* is a button for accepting various settings within the heat pump system 1. Further, when this menu button 96 is pressed down, the user or a builder of the heat pump system 1 is also able to perform a setting for changing the capacity of the auxiliary heat source 53 (for example, 3 kW, 6 kW, 12 kW, and the like) in accordance with, for example, the situation of the national power source with which the heat pump system 1 is installed.

<Action>

The action of the heat pump system 1 shall now be described. Examples of different types of operations of the heat pump system 1 primarily include a hot water supply operation and a heating operation.

—The Hot Water Supply Operation and the Heating Operation—

In both the case of the hot water supply operation and the case of the heating operation, in the heat source-side refrigerant circuit 20, the heat source-side switching mechanism 23 is switched to the heat source-side evaporating operating state (the state shown by the dashed lines of the heat source-side switching mechanism 23 in FIG. 1), and the intake return expansion valve 26*a* adopts a closed state. The heat source-side heat exchanger 24 functions as an evaporator, and the usage-side heat exchanger 41 functions has a heat radiator.

In the heat source-side refrigerant circuit 20 in such a state, the low-pressure heat source-side refrigerant in the refrigeration cycle is drawn through the heat source-side intake tube 21*c* into the heat source-side compressor 21, compressed to a high pressure in the refrigeration cycle, and then discharged to the heat source-side discharge tube 21*b*. The high-pressure heat source-side refrigerant discharged to the heat source-side discharge tube 21*b* has the refrigerating machine oil separated in the oil separator 22*a*. The refrigerating machine oil separated from the heat source-side refrigerant in the oil separator 22*a* is returned to the heat source-side intake tube 21*c* through the oil return tube 22*b*. The high-pressure heat source-side refrigerant from which the refrigerating machine oil has been separated is sent through the heat source-side switching mechanism 23, the second heat source-side gas refrigerant tube 23*b*, and the gas-side shut-off valve 30 to the gas refrigerant interconnecting tube 14 from the heat source unit 2.

The high-pressure heat source-side refrigerant sent to the gas refrigerant interconnecting tube 14 is sent to the usage unit 4. The high-pressure heat source-side refrigerant sent to the usage unit 4 is sent through the usage-side refrigerant tubes 46, 45 to the usage-side heat exchanger 41. The high-pressure heat source-side refrigerant sent to the usage-side heat exchanger 41 radiates heat in the usage-side heat exchanger 41 through heat exchange with the aqueous medium circulating through the aqueous medium circuit 80. Having radiated heat in the usage-side heat exchanger 41, the high-pressure heat source-side refrigerant is sent from the usage-side unit 4 to the liquid refrigerant interconnecting tube 13 through the usage-side flow rate adjustment valve 42 and the usage-side refrigerant tube 45.

The heat source-side refrigerant sent to the liquid refrigerant interconnecting tube 13 is sent to the heat source unit 2. The heat source-side refrigerant sent to the heat source unit 2 is sent through the liquid-side shut-off valve 29 to the supercooler 27. The heat source-side refrigerant sent to the supercooler 27 is sent to the heat source-side expansion valve 25 without undergoing heat exchange in the supercooler 27, because the heat source-side refrigerant does not flow to the intake return tube 26 (i.e., because the intake return expansion valve 26*a* is closed). The heat source-side refrigerant sent to the heat source-side expansion valve 25 is depressurized in the heat source-side expansion valve 25 into a low-pressure gas-liquid two-phase state, and is then sent through the heat source-side liquid refrigerant tithe 24*a* to the heat source-side heat exchanger 24. The low-pressure refrigerant sent to the heat source-side heat exchanger 24 is evaporated in the heat source-side heat exchanger 24 by heat exchange with outdoor air supplied by the heat source-side fan 32. The low-pressure heat source-side refrigerant evaporated in the heat source-side heat exchanger 24 is sent through the first heat source-side gas refrigerant tube 23*a* and the heat source-side switching mechanism 23 to the heat source-side accumulator 28. The low-pressure heat source-side refrigerant sent to the heat source-side accumulator 28 is again drawn into the heat source-side compressor 21 through the heat source-side intake tube 21*c*.

In both the case of the hot water supply operation and the heating operation, an operation for heating the aqueous medium is performed in the aqueous medium circuit 80. Specifically, the aqueous medium circulating through the aqueous medium circuit 80 is heated by the dissipating heat of the heat source-side refrigerant in the usage-side heat exchanger 41. The aqueous medium having been heated in the usage-side heat exchanger 41 (i.e., warn water) is introduced to the aqueous medium-side switching mechanism 161 via the usage-side water outlet tube 18.

Herein, in the case of the hot water supply operation, the aqueous medium-side switching mechanism 161 does not supply aqueous medium to the warm-water heating unit 9, but switches to a state where aqueous medium is supplied only toward the hot-water storage unit 8. Accordingly, in the case of the hot water supply operation, the aqueous medium having been pressurized by the circulation pump 43 (i.e., the warm water) sent to the hot-water storage unit 8 from the usage unit 4 via the aqueous medium interconnecting tube 16. The aqueous medium sent to the hot-water storage unit 8 radiates heat in the heating exchange coil 82 through heat exchange with the aqueous medium inside the hot-water storage tank 81. The aqueous medium inside the hot-water storage tank 81 is thereby heated.

In the case of the warming operation, the aqueous medium-side switching mechanism 161 switches to a state where the aqueous medium is supplied to the hot-water storage unit 8 and the warm-water heating unit 9, or only to the warm-water heating unit 9. Accordingly, in the case of the heating operation, the aqueous medium having been pressurized by the circulation pump 43 (i.e., the warm water) is sent to the hot-water storage unit 8 and the warm-water heating unit 9, or only to the warm-water heating unit 9, from the usage unit 4 via the aqueous medium interconnecting tube 16. The aqueous medium sent to the hot-water storage unit 8 (i.e., the warm water) radiates heat in the heat exchange coil 82 through heat exchange with the aqueous medium inside the hot-water storage tank 81. The aqueous medium inside the hot-water storage tank 81 is thereby heated. The aqueous medium sent to the warm-water heating unit 9 radiates heat in the heat exchange panel 91. The indoor wall or the like and/or the indoor floor will thereby be heated.

The aqueous medium after having exchanged heat in the hot-water storage unit 8 and the warm-water heating unit 9 is drawn into and pressurized by the circulation pump 43 and is thereafter sent to usage-side heat exchanger 41 via the usage-side water inlet tube 47, to again exchange heat with the heat source-side refrigerant.

—The Flow of the Overall Action of the Heat Pump System 1—

Figure 5:
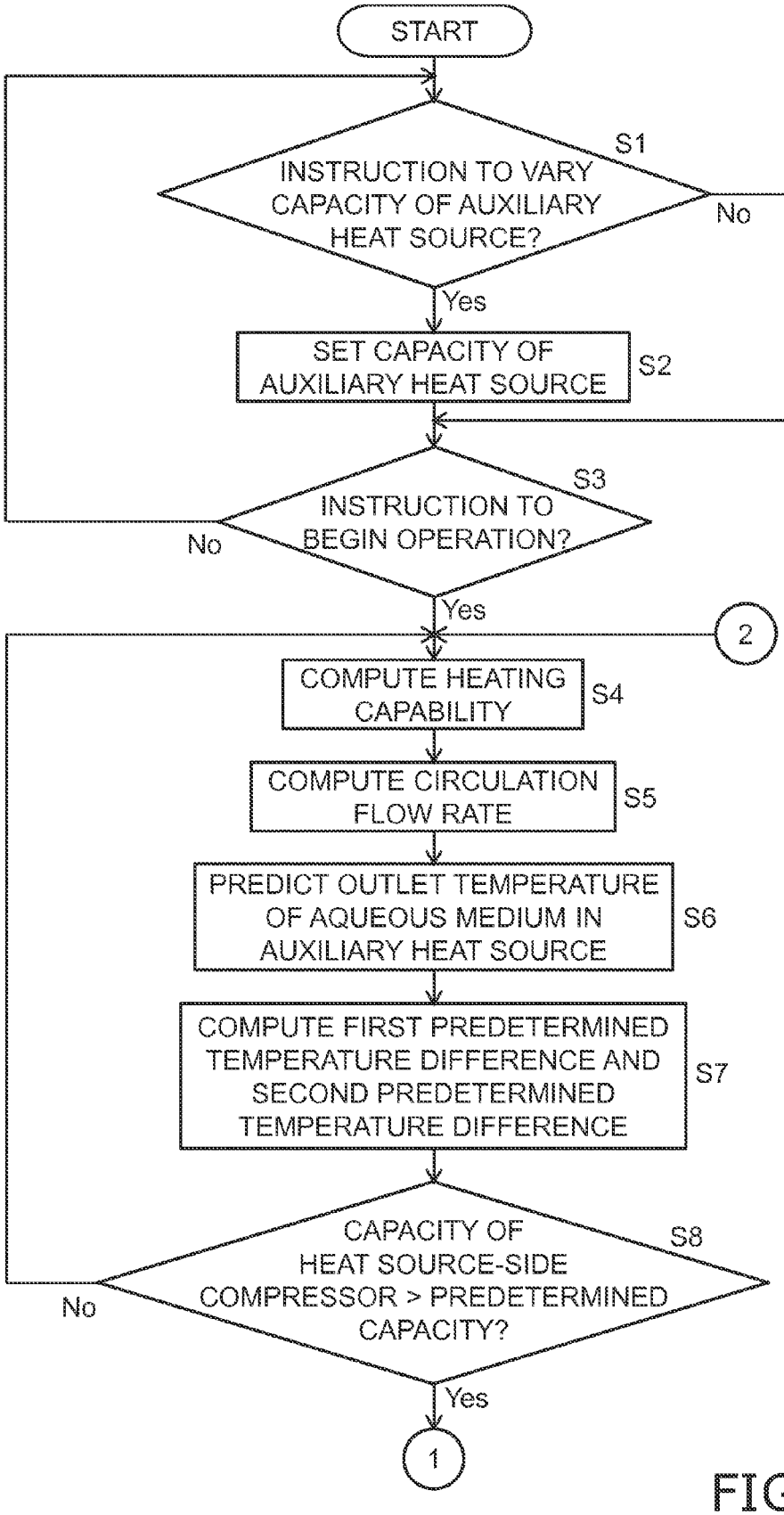
FIG. 5 is a flow chart for illustrating the flow of the overall action of the heat pump system according to the present embodiment in a case where the system is performing a hot water supply operation and a heating operation.
Figure 6:
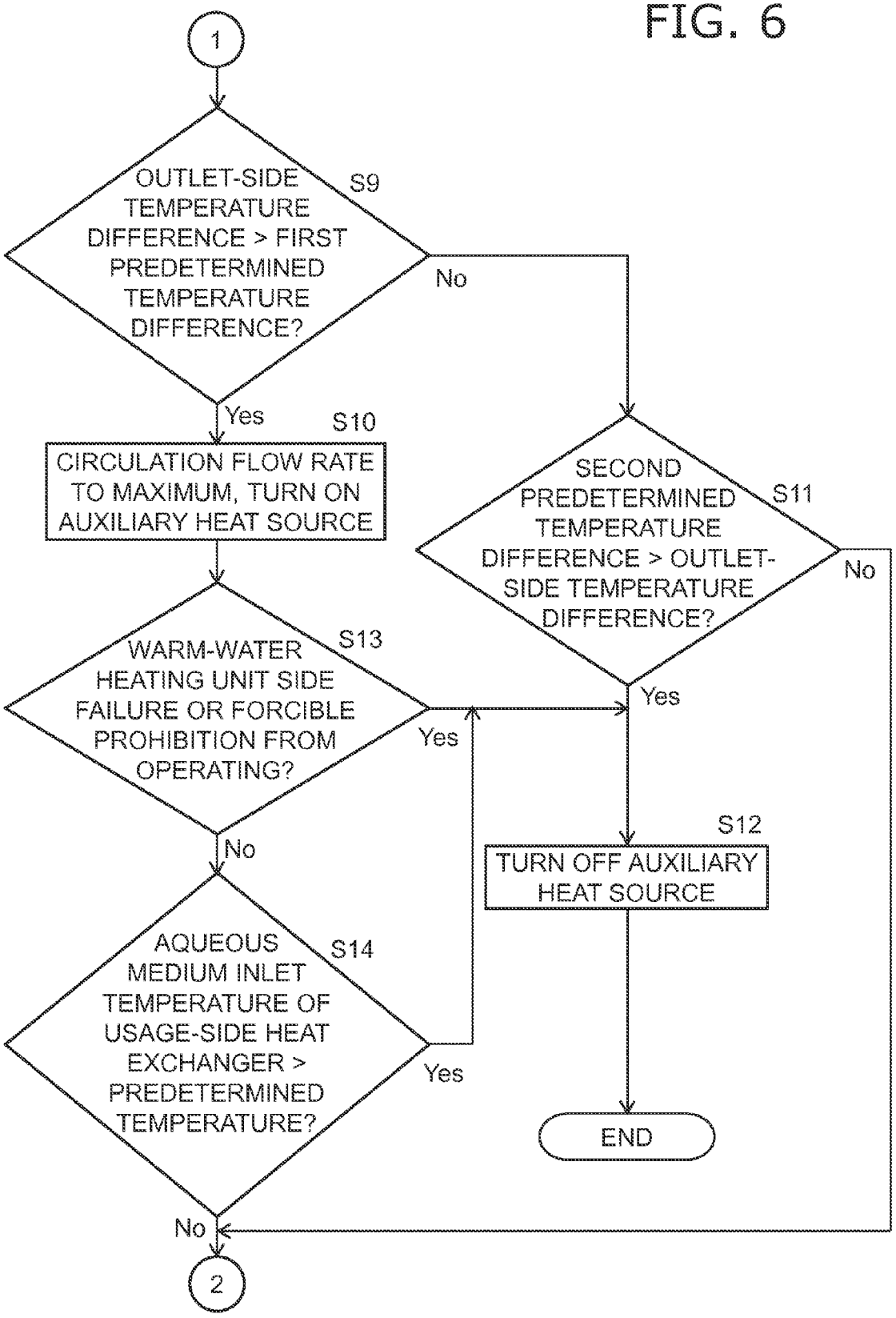
FIG. 6 is a flow chart for illustrating the flow of the overall action of the heat pump system according to the present embodiment in a case where the system is performing a hot water supply operation and a heating operation.

FIGS. 5 and 6 are flow charts for illustrating the flow of the overall action of the heat pump system 1 according to the present embodiment in a case where the system 1 is performing the hot water supply operation or a heating operation. The following, as an introduction, adopts a state where the heat pump system 1 is not operating.

Steps S1-S2: In a case where the menu button 96*a* of the remote controller 90 has been pressed by a user or the like, thereby instructing that the capacity of the auxiliary heat source 53 is to be varied (S1 in "Yes"), the capacity of the auxiliary heat source 53 is set to the instructed capacity value (S2).

In a case where no instruction is made to vary the capacity of the auxiliary heat source 53 (S1 in "No"), the capacity of the auxiliary heat source 53 is set to a pre-determined default value or to a capacity value set in a last time.

Step S3: In a case where an instruction for the hot water supply operation or the heating operation has been made by the user via the remote controller 90 (S3 in "Yes"), the heat pump system 1 begins the hot water supply operation or the heating operation.

Step S4: After the heat pump system 1 has begun the hot water supply operation or the heating operation, the usage-side controller 19, functioning as the heating capability computation unit 191, computes the heating capability Ha of the hot-water storage unit 8 and the warm-water heating unit 9, on the basis of the operating state quantity of the constituent devices or the refrigerant flowing through the heat source-side refrigerant circuit 20.

Step S5: Subsequently, the usage-side controller 19, functioning as the circulation flow rate computation unit 192, detects the current rotational speed rp of the acting circulation pump 43. The usage-side controller 19 also computes the circulation flow rate Frw of the aqueous medium at the current rotational speed of the circulation pump 43, on the basis of the outlet/inlet temperature difference ΔTwl of the aqueous medium in the usage-side heat exchanger 41 and of the heating capability Ha according to step S4.

Step S6: Subsequently, the usage-side controller 19, functioning as the prediction unit 193, predicts the outlet temperature Th1 of the aqueous medium in the auxiliary heat source 53 in the case where the auxiliary heat source 53 has acted, on the basis of the circulation flow rate Frw of the aqueous medium according to step S5, and the heat source capability information Ihc.

Step S7: The usage-side controller 19, functioning as the heat source operation controller 195, determines the first predetermined temperature difference ΔT1 and the second predetermined temperature difference ΔT2 on the basis of the outlet temperature Th1 of the aqueous medium in the auxiliary heat source 53 predicted in step S6.

Steps S8-S10: in a case where the capacity of the heat source-side compressor 21 is a predetermined capacity or greater (S8 in "Yes") and where the outlet-side temperature difference ΔTwl in the usage-side heat exchanger 41 is the first predetermined temperature difference ΔT1 or higher (S9 in "Yes"; ΔTwl>ΔT1), the usage-side controller 19 varies the capacity of the circulation pump 43, such that the flow rate of the aqueous medium over the aqueous medium circuit 80 reaches the rated flow rate or the maximum flow rate of the circulation pump 43, and also turns on the auxiliary heat source 53 (S10). After the auxiliary heat source 53 has been turned on, the usage-side controller 19 controls the capacity of the circulation pump 43 such that the flow rate of the aqueous medium over the aqueous medium circuit 80 reaches a predetermined flow rate.

In step S8, in a case where the capacity of the heat source-side compressor 21 is not the predetermined capacity or greater (58 in "No"), the actions of step S4 onward are repeated.

Steps S11-S12: In a case where the outlet-side temperature difference ΔTw 1 in the usage-side heat exchanger 41 is the second predetermined temperature difference ΔT2 or lower (SU in "Yes"; ΔTwl<ΔT2), the usage-side controller 19 turns off the auxiliary heat source 53 (S12).

In a case where, in step S9, the outlet-side temperature difference ΔTwl in the usage-side heat exchanger 41 is not the first predetermined temperature difference ΔT1 or greater (S9 in "No"), and, in step S11, the outlet-side temperature difference ΔTwl in the usage-side heat exchanger 41 is also not the second predetermined temperature difference ΔT2 or lower (S11 in "No"), then the actions of step S4 onward are repeated while the state of the auxiliary heat source 53 at the current point in time (specifically, a state where the auxiliary heat source 53 is operating, or a state where the auxiliary heat source 53 is not operating) is maintained unchanged.

Steps S13-S14: In a case where, after the auxiliary heat source 53 has been turned on in step S10 (510 in "Yes"), the hot-water storage unit 8 and the warm-water heating unit 9 have failed or have been forcibly prohibited from operating (S13 in "Yes"), or a case where the aqueous medium inlet temperature Twr in the usage-side heat exchanger 41 is a predetermined temperature or higher (S14 in "Yes"), the usage-side controller 19 turns off the auxiliary heat source 53 (S12).

In a case where the hot-water storage unit 8 and the warm-water heating unit 9 have neither failed nor been forcibly prohibited from operating (S13 in "No") and where the aqueous medium inlet temperature Twr in the usage-side heat exchanger 41 is the predetermined temperature or lower (514 in "No"), the actions of step S4 onward are repeated.

<Features>

This heat pump system 1 has features as follows.

(1)

According to this heat pump system 1, the circulation flow rate Frw of the aqueous medium over the aqueous medium circuit 80 is computed on the basis of the heating capability Ha of the hot-water storage unit 8 and the warm-water heating unit 9 as obtained by computation, and of the outlet/inlet temperature difference ΔTwl of the aqueous medium in the usage-side heat exchanger 41. The outlet temperature Th1 of the aqueous medium in the auxiliary heat source 53 is predicted on the basis of the computation result Frw and of the heat source capability information the indicative of the capability of the auxiliary heat source 53.

Accordingly, even without the provision of a temperature sensor near the outlet of the auxiliary heat source 53, it is possible to know the outlet temperature Th1 of the aqueous medium in the auxiliary heat source 53.

(2)

According to this heat pump system 1, a variable-capacity-type pump is used as the circulation pump 43 over the aqueous medium circuit 80. This makes it possible to ensure a suitable amount of flow rate of the aqueous medium circulating through the aqueous medium circuit 80. Further, according to this heat pump system 1, the circulation flow rate Frw at the current rotational speed of the circulation pump 43 over the aqueous medium circuit 80 is computed on the basis of the outlet/inlet temperature difference ΔTwl and the heating capability Ha, and this circulation flow rate Frw is used in the prediction of the outlet temperature Th1 of the aqueous medium. This makes it possible to more accurately predict the actual outlet temperature Th1.

(3)

According to this heat pump system 1, when the auxiliary heat source 53 acts, the flow rate of the aqueous medium reaches a maximum. Accordingly, after the aqueous medium of the flow rate reaching the rated flow rate or the maximum flow rate of the circulation pump 43 has been heated by the usage-side heat exchanger 41, the aqueous medium will thereafter be further heated by the auxiliary heat source 53.

(4)

According to this heat pump system 1, in a case where the capacity of the heat source-side compressor 21 is the predetermined capacity or greater and where the outlet-side temperature difference of the aqueous medium in the usage-side heat exchanger 41 is the first predetermined temperature difference ΔT1 or higher, the auxiliary heat source 53 performs an operation. Thereby, even in a case where, with only heating of the aqueous medium by the usage-side heat exchanger 41, the temperature of the aqueous medium does not reach a desired temperature, further heating by the auxiliary heat source 53 will cause the hot-water storage unit 8 and the warm-water heating unit it to be supplied with aqueous medium of the desired temperature.

(5)

According to this heat pump system 1, the auxiliary heat source 53 discontinues operation in a case where the outlet-side temperature difference is the second predetermined temperature difference ΔT2 or lower, the second predetermined temperature difference ΔT2 being lower than the first predetermined temperature difference ΔT1, in other words, where the outlet temperature Twl of the aqueous medium in the usage-side heat exchanger 41 is close to a target outlet temperature Twls, because the hot-water storage unit 8 and the warm-water heating unit 9 have obtained the aqueous medium of the desired temperature and there is no need for the auxiliary heat source 53 to be made to operate any further. This makes it possible to prevent power consumption caused by unnecessary operation of the auxiliary heat source 53.

(6)

According to this heat pump system 1, the first predetermined temperature difference ΔT1 and the second predetermined temperature difference ΔT2 are variables determined on the basis of the predicted outlet temperature Th1 of the aqueous medium in the auxiliary heat source 53. This makes it possible for the outlet-side temperature difference to be compared with the first predetermined temperature difference ΔT1 and the second predetermined temperature difference ΔT2, which are changed depending on the outlet temperature Th1 of the aqueous medium in the auxiliary heat source 53 as predicted from time to time, whereby the operation of the auxiliary heat source 53 can be begun or discontinued as appropriate.

(7)

According to this heat pump system 1, the auxiliary heat source 53 is forcibly made to discontinue operating in a case where the hot-water storage unit 8 and the warm-water heating unit 9 have failed or have been forcibly prohibited from operating. The aqueous medium will thereby not continue to be further heated by the operation of the auxiliary heat source 53 when the hot-water storage unit 8 and the warm-water heating unit 9 fail or are prohibited from operating. Accordingly, it is possible to prevent an accident or the like and/or further failure of the heat pump system 1 caused with the auxiliary heat source 53 as a factor. It is also possible to keep low the power consumed by the operation of the auxiliary heat source 53.

(8)

As described above, the computed heating capability Ha of the hot-water storage unit 8 and the warm-water heating unit 9, the circulation flow rate Frw of the aqueous medium, and the like are used to predict the outlet temperature Th1 of the aqueous medium in the auxiliary heat source 53, but, depending on the case, a concern is presented in that the prediction result Th1 may be different from the actual outlet temperature of the aqueous medium. In view whereof, according to this heat pump system 1, the operation of the auxiliary heat source 53 is discontinued where necessary while the temperature of the aqueous medium coming back to the usage-side heat exchanger 41, i.e., the inlet temperature Twr of the aqueous medium in the usage-side heat exchanger 41, is also being monitored. Thereby, even in a provisional case where the prediction result Th1 is different from the actual outlet temperature of the aqueous medium, the operation of the auxiliary heat source 53 will be controlled as appropriate on the basis of the inlet temperature Twr of a water heat source.

(9)

According to this heat pump system 1, the capacity of the auxiliary heat source 53 can be changed via the menu button 96*a* of the remote controller 90 or the like. This makes it possible to vary as appropriate the capacity of the auxiliary heat source 53 in accordance with, for example the circumstances of the national power source with which the heat pump system 1 is installed.

<Modification Examples of the Heat Pump System 1 According to the Present Embodiment>

(A)

In the description of the heat pump system 1 above, the auxiliary heat source 53 is mounted externally to the aqueous medium interconnecting tube 16 when the heat pump system 1 is installed. However, the auxiliary heat source 53 may also be mounted near the outlet of the usage-side heat exchanger 41 inside the usage unit 4 when the usage unit 4 is assembled (prior to shipment of the usage unit 4).

(B)

In the description of the heat pump system 1 above, the computations of the heating capability Ha and the circulation flow rate Fwr as well as the prediction of the outlet temperature 717*h*1 of the aqueous medium in the auxiliary heat source 53 are done by the usage-side controller 19 of the usage unit 4. However, the computations of the heating capability Ha and the circulation flow rate Fwr as well as the prediction of the outlet temperature Th1 of the aqueous medium in the auxiliary heat source 53 may also be performed in the heat source-side controller 12 on the heat source unit 2 side. Further, for example, the computation of the heating capability Ha may be performed by the heat source-side controller 12, and the computation of the circulation flow rate Fwr and the prediction of the outlet temperature Th1 of the aqueous medium in the auxiliary heat source 53 may be performed by the usage-side controller 19.

(C)

The description of the heat pump system 1 above is of a case where, as illustrated by S4 of FIGS. 5 and 6, the computation of the heating capability Ha is performed on a regular basis. However, the computation of the heating capability Ha may be performed, for example, only when the heat pump system 1 is started up, in a case where the value of the heating capability Ha is a value comparatively less prone to changing.

(D)

The description of the heat pump system 1 above is of a case where, as illustrated in FIG. 1, the heat source unit 2 and the usage unit 4 are provided separately. However, the heat source unit 2 and the usage unit 4 may also be configured, for example, as a single unit. In such a case, too, the auxiliary heat source 53 is mounted onto the aqueous medium interconnecting tubes 15, 16 through which the aqueous medium being supplied to the hot-water storage unit 8 and the warm-water heating unit 9 flows.

(E)

The description of the heat pump system 1 above is of a case where one usage unit 4 is connected to one heat source unit 2. However, the number of the usage units 4 may also be a plurality. In such a case, the hot-water storage unit 8, the warm-water heating unit 9, and other aqueous medium devices are connected to each of the usage units 4, and the auxiliary heat source 53 is mounted onto each of the aqueous medium interconnecting tubes 16 joining the aqueous medium devices with each of the usage units 4.

(F)

The description of the heat pump system 1 above is of a case where the usage unit 4 for using the aqueous medium is connected to the heat source unit 2. However, in addition to the usage unit 4 for using the aqueous medium, an air conditioner for using the heat source-side refrigerant to provide air condition may also be connected to the heat source unit 2.

INDUSTRIAL APPLICABILITY

When the present invention is used, the heat pump system provided with the auxiliary heat source is able to use the heat pump cycle to heat the aqueous medium, wherein it is possible to know the outlet temperature of the aqueous medium in the auxiliary heat source, without the provision of a temperature sensor near the outlet of the auxiliary heat source.

What is claimed is:

1. A heat pump system, comprising:

a refrigerant circuit having a compressor configured to compress a refrigerant, a heat source-side heat exchanger configured to function as an evaporator of the refrigerant, and a refrigerant-water heat exchanger configured to function as a heat radiator of the refrigerant and to heat an aqueous medium, the compressor being a variable-capacity-type compressor;

an aqueous medium circuit having a circulation pump and the refrigerant-water heat exchanger, the aqueous medium exchanging heat with the refrigerant in the refrigerant-water heat exchanger and being circulated in the aqueous medium circuit, and the aqueous medium circuit being connected to aqueous medium devices configured to use the aqueous medium to perform an operation;

an auxiliary heat source configured to further heat the aqueous medium circulating in the aqueous medium circuit, the auxiliary heat source being provided at an aqueous medium outlet side of the refrigerant-water heat exchanger in the aqueous medium circuit;

a heating capability computation unit configured to compute a heating capability of the aqueous medium devices based on an operating state quantity of constituent devices or the refrigerant flowing through the refrigerant circuit;

a circulation flow rate computation unit configured to compute a circulation flow rate of the aqueous medium in the aqueous medium circuit based on the heating capability and an outlet/inlet temperature difference between an inlet temperature and an outlet temperature of the aqueous medium in the refrigerant-water heat exchanger;

a prediction unit configured to predict an outlet temperature of the aqueous medium in the auxiliary heat source when the auxiliary heat source has acted based on the circulation flow rate and heat source capability information indicative of a capacity of the auxiliary heat source; and a heat source operation controller configured to cause the auxiliary heat source to perform an operation when the capacity of the compressor is a predetermined capacity of higher, and an outlet-side temperature difference between a target outlet temperature and the outlet temperature of the aqueous medium in the refrigerant-water heat exchanger is a first predetermined temperature difference or higher.

2. The heat pump system according to claim 1, wherein the circulation pump is a variable-capacity-type pump; and the circulation flow rate computation unit computes the circulation flow rate at a current rotational speed of the circulation pump.

3. The heat pump system according to claim 2, further comprising a pump capacity controller configured to perform a control, when the auxiliary heat source begins to act, in which the capacity of the circulation pump is varied such that the flow rate of the aqueous medium in the aqueous medium circuit reaches a rated flow rate or a maximum flow rate of the circulation pump.

4. The heat pump system according to claim 3, wherein the auxiliary heat source is a variable-capacity heat source; and the heat pump system further comprises an accepting unit configured to accept a setting for the capacity of the auxiliary heat source.

5. The heat pump system according to claim 2, wherein when the auxiliary heat source is operating, the heat source operation controller discontinues the operation of the auxiliary heat source when the outlet-side temperature difference is a second predetermined temperature difference or lower, the second predetermined temperature difference being lower than the first predetermined temperature difference.

6. The heat pump system according to claim 5, wherein the first predetermined temperature difference and the second predetermined temperature difference are determined based on the predicted outlet temperature from the prediction unit.

7. The heat pump system according to claim 2, wherein the heat source operation controller discontinues the operation of the auxiliary heat source irrespective of the operation capacity of the compressor when the aqueous medium devices fail or are forcibly prohibited from operating when the auxiliary heat source is operating.

8. The heat pump system according to claim 2, wherein the heat source operation controller discontinues the operation of the auxiliary heat source when the inlet temperature of the aqueous medium in the refrigerant-water heat exchanger is a predetermined temperature or higher when the auxiliary heat source is operating.

9. The heat pump system according to claim 2, wherein the auxiliary heat source is a variable-capacity heat source; and the heat pump system further comprises an accepting unit configured to accept a setting for the capacity of the auxiliary heat source.

10. The heat pump system according to claim 1, wherein when the auxiliary heat source is operating, the heat source operation controller discontinues the operation of the auxiliary heat source when the outlet-side temperature difference is a second predetermined temperature difference or lower, the second predetermined temperature difference being lower than the first predetermined temperature difference.

11. The heat pump system according to claim 10, wherein the first predetermined temperature difference and the second predetermined temperature difference are determined based on the predicted outlet temperature from the prediction unit.

12. The heat pump system according to claim 1, wherein the heat source operation controller discontinues the operation of the auxiliary heat source irrespective of the operation capacity of the compressor when the aqueous medium devices fail or are forcibly prohibited from operating when the auxiliary heat source is operating.

13. The heat pump system according to claim 1, wherein the heat source operation controller discontinues the operation of the auxiliary heat source when the inlet temperature of the aqueous medium in the refrigerant-water heat exchanger is a predetermined temperature or higher when the auxiliary heat source is operating.

14. The heat pump system according to claim 1, wherein the auxiliary heat source is a variable-capacity heat source; and the heat pump system further comprises an accepting unit configured to accept a setting for the capacity of the auxiliary heat source.

* * * * *